US005488984A

United States Patent [19]

Fahy

[11] Patent Number: 5,488,984

[45] Date of Patent: Feb. 6, 1996

[54] ELECTRIC MOTOR ROTOR LAMINATION TREATMENT TO PREVENT ROTOR SOLDERING

[75] Inventor: Chris K. Fahy, Springfield, Ohio

[73] Assignee: A. O. Smith Corporation, Milwaukee, Wis.

[21] Appl. No.: 253,645

[22] Filed: Jun. 3, 1994

[51] Int. Cl.[6] ..... B22D 19/10; B22D 19/00

[52] U.S. Cl. ..... 164/91; 164/101

[58] Field of Search ..... 164/75, 100, –102, 164/91

[56] References Cited

U.S. PATENT DOCUMENTS 5,161,597 11/1992 Dohogne ..... 164/109

*Primary Examiner*—P. Austin Bradley

*Assistant Examiner*—I.-H. Lin

*Attorney, Agent, or Firm*—James Earl Lowe, Jr.

[57] ABSTRACT

A method for the mass production of squirrel-cage rotors for electric motors includes the step of die casting-in-place rotor bars within the slots formed by stacked steel laminations. The molten metal alloy utilized in the method is high conductivity aluminum. Before introduction of the molten aluminum, the steel laminations are treated in a solution of sodium nitrite, sodium tetraborate decahydrate, and a wetting agent to prevent soldering of the aluminum to the steel.

6 Claims, 2 Drawing Sheets

ELECTRIC MOTOR ROTOR LAMINATION TREATMENT TO PREVENT ROTOR SOLDERING

BACKGROUND OF THE INVENTION

This invention relates to a method for preventing soldering of high purity aluminum to steel, and, more particularly, to the mass production of squirrel-cage rotors for electric motors.

It is well known to produce squirrel-cage rotors by stamping a plurality of generally circular, high magnetically permeable laminations from thin steel sheet stock. The laminations each include a central bore and a plurality of identical generally radial notches spaced around the circumference at equal angular intervals about the outer margin of the lamination. The laminations are then stacked and compressed within a die casting mold to form a core having a longitudinal central bore there through and slots spaced around the circumference which extend longitudinally through the core at the outer margins thereof. The laminations are skewed such that the slots are wrapped slightly around the longitudinal axis of the core in a somewhat helical fashion. Molten metal is then injected into the slots formed by the laminations to produce spaced bars along the outer margins of the core, as well as end rings which hold the laminations in place.

It is also known that in order to produce the very best motor performance possible, the electric conductivity of the bars should be as high as possible. It has been generally accepted that the bars should be formed from the highest purity aluminum, and thus the highest conductivity aluminum, which is available. The aluminum which has been generally utilized by motor manufacturers has a very low iron content of about 0.1% to 0.2% by volume.

It is known in the art that molten aluminum is very aggressive toward unprotected steels, with the result that molten aluminum often solders to unprotected steels. It was also common in past motor manufacturing procedures to heat treat laminations after punching to mitigate aluminum soldering in rotor casting. That is, stator and rotor laminations often still are heat treated, or acid etched to form an oxide layer on the bare metal to help prevent the aluminum from soldering to the steel. When oxidation steps are provided in a motor construction, they add cost to the product and the degree of oxidation is hard to control. Consequently, even where oxidation steps are included in the motor manufacturing process, it still is possible to have production problems with rotors using conventional construction techniques.

Sodium borate has been used in the past in an attempt to form an electrically resistive barrier on both the lamination interfaces and the rotor bar slots. The sodium borate alone, however, has not been successful for this application.

SUMMARY OF THE INVENTION

It is an object of the invention to provide a method for the mass production of squirrel-cage rotors for electric motors which eliminates the need for acid treat or atmospheric heat treatments of the laminations, prior to injection of molten aluminum into the lamination core, in order to alleviate the problems associated with soldering of the aluminum to the core.

It is a further object of the invention to provide a method for the mass production of squirrel-cage rotors which utilizes a molten aluminum alloy for casting-in-place rotor bars within the lamination core, the bars consisting essentially of high purity aluminum.

It is a still further object of the invention to provide a more economical method of mass producing squirrel-cage rotors for electric motors using less expensive materials and procedures while decreasing the rate of defective motor production.

It has been discovered that when rotors are produced with laminations treated with sodium tetraborate decahydrate, sodium nitrite, and a wetting agent, this eliminates any soldering problems when molten high purity aluminum is injected into the laminations.

When utilized for mass production of rotors for electric motors, the present invention provides the advantages of: 1) reducing the number of defective motors produced; i.e., those which do not exhibit the proper level of pull-up torque; 2) eliminating of a heating operation; 3) permitting the use of a more benign treatment; and 4) allowing the rotor to be more economically produced by eliminating the need for acid treating and atmospheric heat treatment of the laminations.

These as well as other objects and advantages will become more apparent upon a reading of the following description of the preferred embodiments wherein the structure of a rotor for an electric motor is illustrated, and the prior art method and the method of the present invention are compared.

Figure 1:
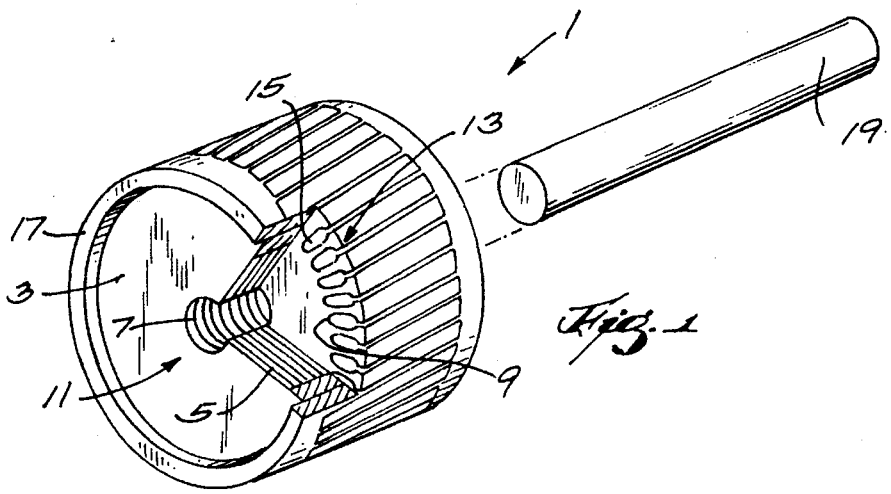
FIG. 1 is a perspective view of a squirrel-cage rotor body with a portion thereof cut away for the purpose of illustrating the individual laminations comprising the core, the rotor bars formed in notches in the outer periphery of the core, and a rotor shaft adapted to be shrink fitted in the bore of the rotor body.
Figure 2:
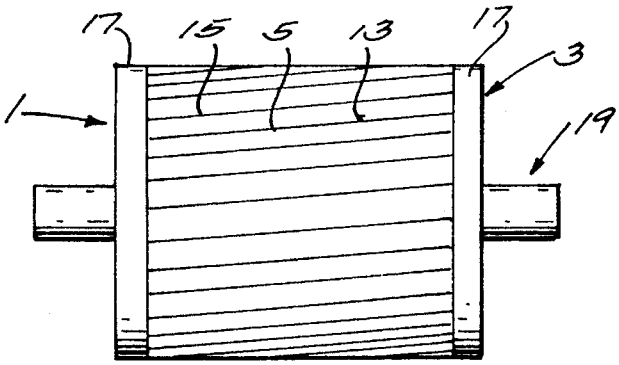
FIG. 2 is a side elevation view of a rotor assembly after having its rotor shaft fitted in its bore.
Figure 3:
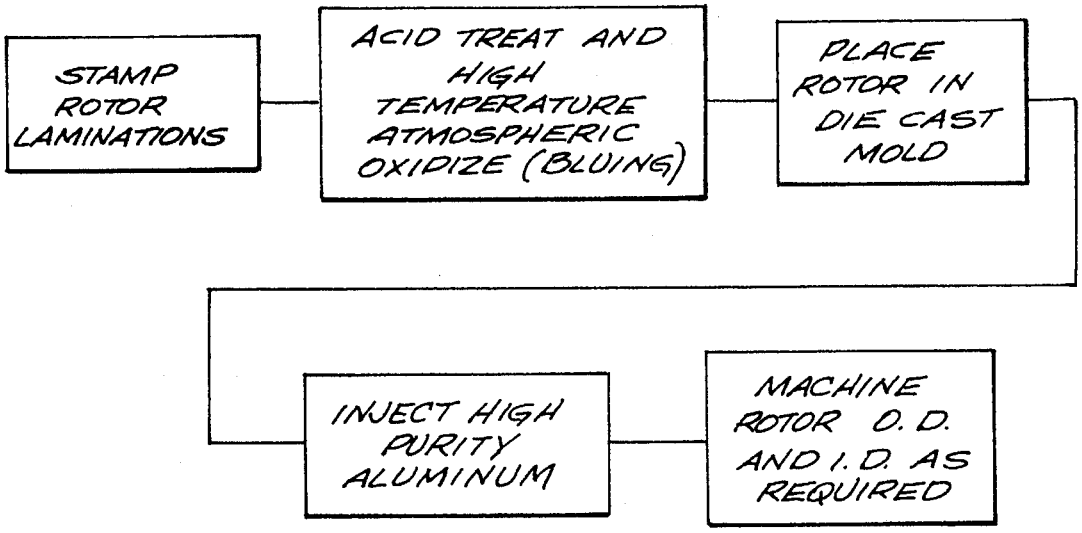
Fig. 3 PRIOR ART
FIG. 3 is a flow chart of the principal steps in forming a squirrel-cage rotor according to the prior art method.
Figure 4:
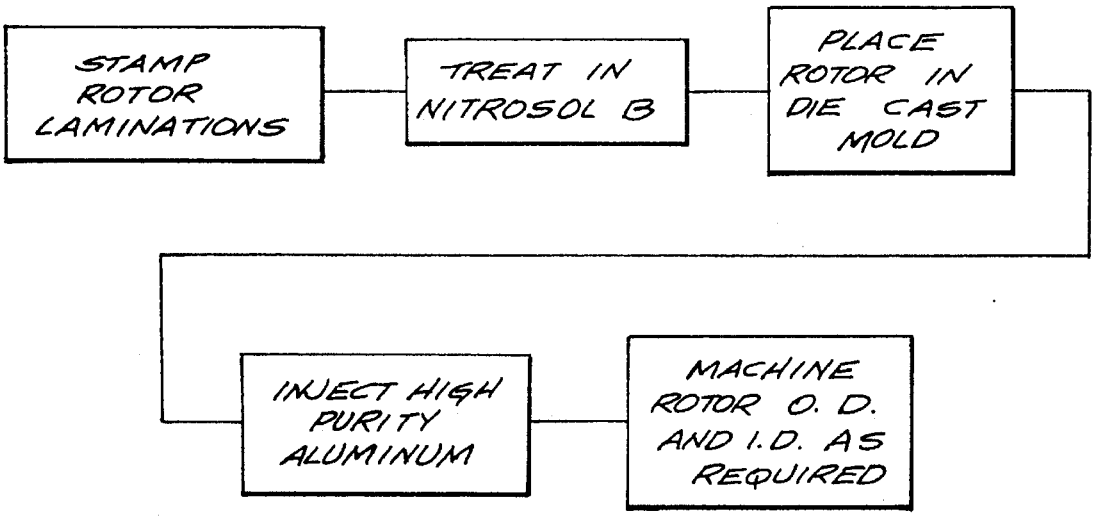
FIG. 4 is a flow chart of the principal steps in mass producing squirrel-cage rotors according to the present invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Referring now to the drawings, a rotor body, as indicated in its entirety by reference character 1, is shown to comprise a core 3 constituted by a stack of identical laminations 5 which are preferably made of thin, plate-like ferro-magnetic material, such as a high magnetic permeability sheet steel or the like. As is conventional, laminations 5 are die punched from sheet steel and have a central opening 7 therethrough and a plurality of identical generally radial notches 9 in their outer margins with the notches spaced at equal angular intervals about the lamination. Upon assembly of the stack of laminations to form the core, the laminations are coaxially arranged so that their central openings 7 form a bore 11 extending longitudinally through the core. The laminations are preferably skewed relative to one another (i.e., angularly displaced from one another) so that their notches 9 form slots 13 which extend longitudinally through the core and which are wrapped slightly around the longitudinal axis of the core in helical fashion. The laminations constituting core 3 are typically secured together in stacked relation under a desired compressive loading by any one of several known means, and the injected aluminum holds the core in desired arrangement after manufacturing. The rotor assembly illustrated is a squirrel-cage rotor and, as is typical, has a plurality of die cast-in-place rotor bars 15 formed within slots 13 and further has die cast end rings 17 formed on the end faces of core 3 unitary with and interconnecting the rotor bars. Typically, core 3 is placed within a die-casting mold (not shown) as stacked pre-treated loose laminations. Molten aluminum is injected under pressure of a piston, or the like, into the mold, the molten aluminum flows into slots 13 to form bars 15, filling the mold cavity to create end rings 17. After die casting, the core assembly, as illustrated in FIG. 1, may be ground or lathed so as to form a uniform and even outer cylindrical surface concentric with the axis of bore 11.

Bore 11 in core 3 is sized and formed as to be shrunk or otherwise fitted on a rotor shaft 19. That is, the inside diameter of bore 11 is slightly smaller at ambient temperature than the outside diameter of shaft 19 so that upon heating of core 3 to a predetermined elevated temperature, the inside diameter of bore 11 will expand or increase to a size sufficient to receive shaft 19 there within. Upon cooling of the core, the latter will contract around the shaft and will securely lock it in place therein thus fixing the core to the shaft. Other interconnecting methods are known in the art and all are compatible with the broader aspects of the invention.

In accordance with the invention, the laminations 5, prior to being placed in the mold, are loosely placed on pegs or are wired together so they can be treated in a solution to prevent the molten high purity aluminum from soldering to the laminations. The solution, in the preferred embodiment, is made by filling a dip tank with eight (8) gallons of Nitrisol B and ninety two (92) gallons of tap water. Experience has shown the Nitrisol B to by volume. water concentration should be between 7 and 10 percent. Nitrisol B is a trade name for a chemical available from Gem City Chemicals, Inc. of 1287 Air City Ave, Dayton, Ohio. The Nitrisol B contains 76.85% water, 4.85% of sodium tetraborate decahydrate, 17.91% sodium nitrite, and 0.39% nonylphenoxypolyethoxyethanol (a wetting agent) by weight.

The dip tank solution is warmed to between 110° and 120° F. The loose laminations are totally submersed in the dip tank solution for three minutes or until bubbles stop rising from the parts. It is recommended that the parts be agitated in the solution either back and forth or up and down during the dip. This helps insure the solution gets between all the laminations. The laminations are then removed from the solution and drained for five (5) minutes. Once dry, the laminations are placed in the mold, as described above.

Various features of the invention are set forth in the following claims.

I claim:

1. A method for molding high purity aluminum around steel, the method comprising the steps of:

treating the steel in a solution including sodium nitrite, and sodium tetraborate decahydrate, and molding the high purity aluminum around the steel.

2. A method according to claim 1 wherein said solution further includes a wetting agent.

3. A method according to claim 1 wherein said solution consists of about 76.85%, by weight of water, 4.85% by weight of sodium tetraborate decahydrate, 17.91% by weight of sodium nitrite, and 0.39% by weight of nonylphenoxypolyethoxyethanol.

4. A method of constructing a rotor for a dynamo electric machine comprising the steps of:

treating a plurality of laminations in a solution including sodium nitrite, sodium tetraborate decahydrate, each of said laminations having a plurality of rotor bar openings formed along their periphery at predetermined angular intervals, placing said laminations in a mold, each of said rotor bar openings being aligned in a predetermined manner in said laminations, and die casting in place rotor bars within said rotor bar openings using high purity aluminum.

5. A method according to claim 4 wherein said solution further includes a wetting agent.

6. A method according to claim 4 wherein said solution consists of about 76.85% by weight of water, 4.85% by weight of sodium tetraborate decahydrate, 17.91% by weight of sodium nitrite, and 0.39% by weight of nonylphenoxypolyethoxyethanol.

* * * * *